US009518721B1

(12) United States Patent
Cohen

(10) Patent No.: US 9,518,721 B1
(45) Date of Patent: Dec. 13, 2016

(54) APPARATUS AND METHOD FOR LIGHT SIGNALING

(71) Applicant: Maurice Cohen, Los Angeles, CA (US)

(72) Inventor: Maurice Cohen, Los Angeles, CA (US)

( * ) Notice: Subject to any disclaimer, the term of this patent is extended or adjusted under 35 U.S.C. 154(b) by 0 days.

(21) Appl. No.: 14/824,649

(22) Filed: Aug. 12, 2015

(51) Int. Cl.

| | |
|---|---|
| ***F21S 4/00*** | (2016.01) |
| ***F21V 21/00*** | (2006.01) |
| ***F21V 15/01*** | (2006.01) |
| ***F21V 23/02*** | (2006.01) |
| ***F21V 23/00*** | (2015.01) |
| ***F21S 9/03*** | (2006.01) |
| ***G08G 1/095*** | (2006.01) |
| *F21Y 101/02* | (2006.01) |
| *F21W 111/00* | (2006.01) |
| *F21W 111/02* | (2006.01) |
| *E01F 9/00* | (2016.01) |

(52) U.S. Cl.
CPC ..... *F21V 15/01* (2013.01); *F21S 9/037* (2013.01); *F21V 23/008* (2013.01); *F21V 23/023* (2013.01); *G08G 1/095* (2013.01); *E01F 9/00* (2013.01); *F21W 2111/00* (2013.01); *F21W 2111/02* (2013.01); *F21Y 2101/02* (2013.01)

(58) Field of Classification Search
CPC ..... F21V 15/01; F21V 23/008; F21V 23/023; F21S 9/037; F21W 2111/00; F21W 2111/02; F21Y 2101/02; E01F 9/016; G08G 1/095; G08G 1/0955
See application file for complete search history.

(56) References Cited

U.S. PATENT DOCUMENTS

| | | | | |
|---|---|---|---|---|
| 5,898,381 | A * | 4/1999 | Gartner | G08G 1/095 340/815.45 |
| 6,762,689 | B2 * | 7/2004 | Dechape | G08G 1/095 340/331 |
| 7,911,357 | B2 * | 3/2011 | Isac | F21V 23/02 116/63 R |
| 2002/0126256 | A1 * | 9/2002 | Larson | G02C 7/108 351/159.56 |
| 2005/0030203 | A1 * | 2/2005 | Sharp | G08G 1/095 340/907 |
| 2006/0038702 | A1 * | 2/2006 | Lo | G08G 1/095 340/907 |
| 2007/0268149 | A1 * | 11/2007 | Chen | G08G 1/095 340/815.45 |
| 2008/0129542 | A1 * | 6/2008 | Chen | G08G 1/095 340/907 |
| 2008/0272936 | A1 * | 11/2008 | Kim | G08G 1/095 340/929 |
| 2010/0182164 | A1 * | 7/2010 | Diba | G09F 9/33 340/907 |

* cited by examiner

*Primary Examiner* — Peggy Neils
*Assistant Examiner* — Alexander Garlen
(74) *Attorney, Agent, or Firm* — Maier & Maier, PLLC

(57) ABSTRACT

According to an exemplary embodiment, an apparatus for light signaling may be provided. The apparatus may include, but not be limited to, a number of LED arrays and OLEDs, a number of LED lighting controllers connected to the number of LED arrays and OLEDs, a power supply connected to the number of LED lighting controllers, a number of protective elements covering the number of LED arrays and OLEDs, a housing containing the number of LED arrays and OLEDs, an electrical box attached to the housing and containing the power supply and the number of LED lighting controllers, and a number of mounting element connected to the housing.

18 Claims, 5 Drawing Sheets

APPARATUS AND METHOD FOR LIGHT SIGNALING

BACKGROUND

Perhaps the most ubiquitous example of light signaling are traffic lights. A typical traffic light include three light sources, corresponding to distinct signals directed at motorists and pedestrians. While some geographical variations exists, typical traffic signal includes a set of red, orange/yellow and blue/green light. Each of these light sources are housed in individual or common protective cases. The cases protect the light sources from the weather but also provide shade to improve the visibility of the light under bright conditions.

The light sources are usually incandescent light bulbs fitted with colored filters, or monochromatic LED units. LED traffic lights have the same general illumination performance as traditional bulbs but present several major advantages over incandescent bulbs. The first advantage of these LED traffic lights is their durability. They typically need to be replaced every 15 years, compared to 1-2 years for incandescent bulbs. A second major advantage of using LED in traffic lights is their very low energy consumption. An array of LED's use only 10%-30% as much energy as an incandescent bulb for a similar light output. This energy conservation can save municipalities, and other entities in charge of signal lights, a significant expense in electricity and maintenance.

Despite the superior performance of the monochromatic LED arrays over incandescent lights, a new generation of LED, multi-colored (RGB) LEDs display an even greater potential. Multicolored light displays using monochromatic LED need to be composed of individual overlapping arrays to display each desired color or to have array composed of sets of multiple monochromatic LEDs. One LED of each color for each point to be illuminated. In contrast, multi-colored (RGB) LEDs are able to generate multiple color from a single part, dramatically reducing the number of electronic components and the risk of failure. More importantly, multi-colored (RGB) LEDs use significantly even less energy than monochromatic LEDs, allowing the production of full-colored display and signals with extremely low operating costs.

SUMMARY

According to an exemplary embodiment, an apparatus for light signaling may be provided. The apparatus may include, but not be limited to, a number of LED arrays and OLEDs, a number of LED lighting controllers connected to the number of LED arrays and OLEDs, a power supply connected to the number of LED lighting controllers, a number of protective elements covering the number of LED arrays and OLEDs, a housing containing the number of LED arrays and OLEDs, an electrical box attached to the housing and containing the power supply and the number of LED lighting controllers, and a number of mounting element connected to the housing.

According to another exemplary embodiment, a method for reducing the cost of light signaling may be provided. The method may include, but not limited to the steps of: obtaining an apparatus for signaling with light, placing the apparatus for signaling in a conspicuous location, connecting the apparatus to a power source, and powering the apparatus. The apparatus may include, but not be limited to, a number of LED arrays and OLEDs, a number of LED lighting controllers connected to the number of LED arrays and OLEDs, a power supply connected to the number of LED lighting controllers, a number of protective elements covering the number of LED arrays and OLEDs, a housing containing the number of LED arrays and OLEDs, an electrical box attached to the housing and containing the power supply and the number of LED lighting controllers, and a number of mounting element connected to the housing.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION

Figure 1:
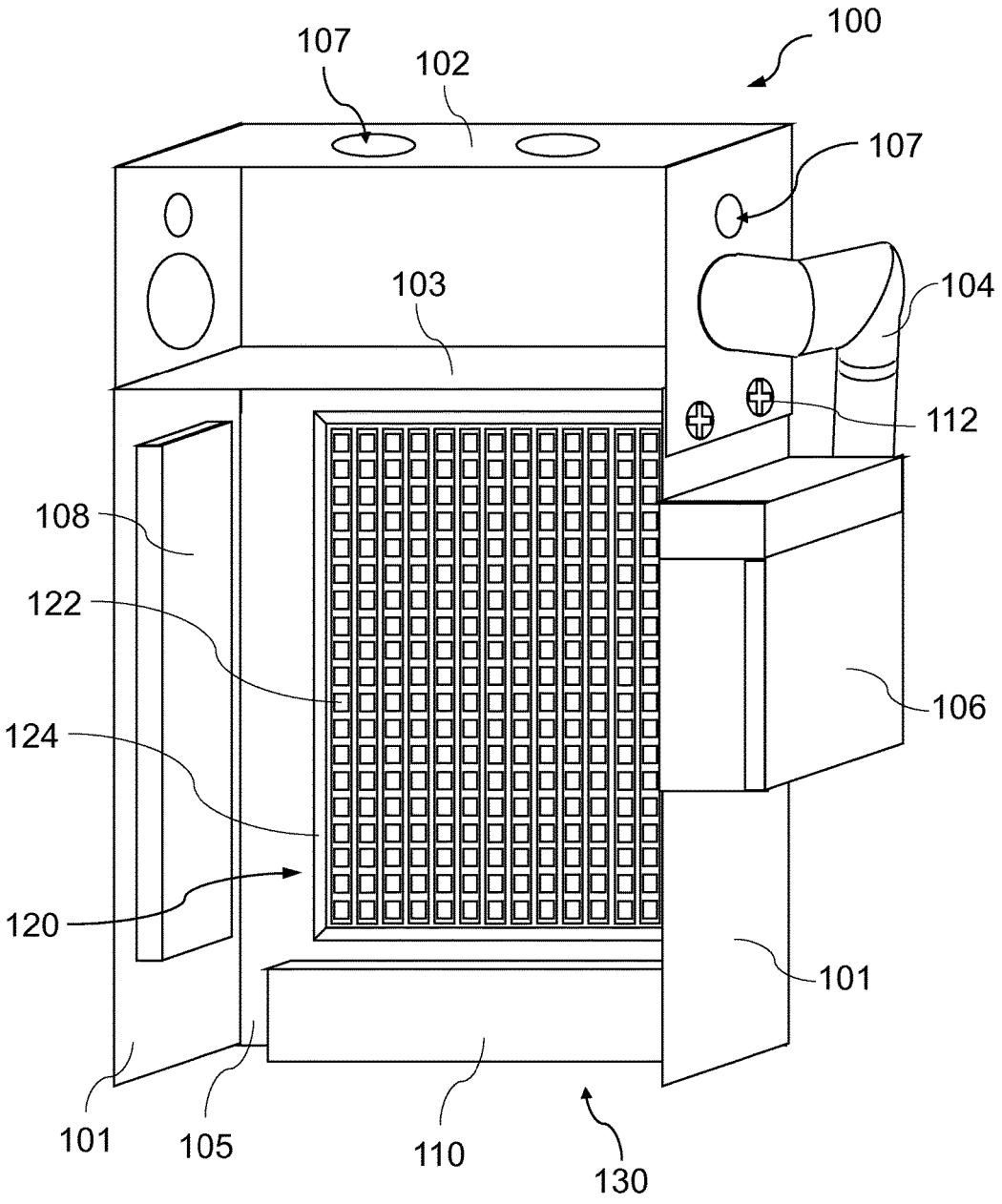
FIG. 1 is a diagram showing an exemplary embodiment of an apparatus, and method for signaling with light.

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Further, many of the embodiments described herein may be described in terms of sequences of actions to be performed by, for example, elements of a computing device. It should be recognized by those skilled in the art that the various sequence of actions described herein can be performed by specific circuits (e.g., application specific integrated circuits (ASICs)) and/or by program instructions executed by at least one processor. Additionally, the sequence of actions described herein can be embodied entirely within any form of computer-readable storage medium such that execution of the sequence of actions enables the processor to perform the functionality described herein. Thus, the various aspects of the present invention may be embodied in a number of different forms, all of which have been contemplated to be within the scope of the claimed subject matter. In addition, for each of the embodiments described herein, the corresponding form of any such embodiments may be described herein as, for example, "a computer configured to" perform the described action.

In an exemplary embodiment, an apparatus and method of light signaling may be provided. The apparatus and method of light signaling may include a number of multi-colored (RGB) LED. The multi-colored (RGB) LED may be arranged in a matrix defined by a geometrical pattern including, but not limited to, square, circular and honeycomb. In an exemplary embodiment, the led array may display colored shapes.

In an alternative exemplary embodiment, the light source may be an organic light-emitting diode (OLED). The OLED may include, but not be limited to, a film of organic compound placed between two electrodes which may emit light when an electric current is applied. It may further be appreciated that, at least one of the electrodes may be transparent and that the assembly including the organic film and the electrodes may be flexible.

In an exemplary embodiment, the multi-colored (RGB) LED may be controlled by at least one secondary electronic device that may modulate particular LED elements to match the particular color frequencies required of a traffic light signaling device. The design of the illuminating unit may effectively reduce the weight and dimensions of the signal box, in addition to reducing the number of unique discrete colored lighting elements with the signaling device. In another exemplary embodiment, the technology may enable the possibility of bi-directional feedback of the LED status remotely for remote monitoring system. The matrix may be housed in a protective housing, which may be square, rectangular or any other desired shape.

Now referring to exemplary FIG. 1, the apparatus for light signaling 100 may be comprised of at least one vertical back plate 105. Two side plates 101 may be rigidly connected to the vertical edges of the at least one vertical back plate 105. A horizontal top plate may be rigidly connected to the top edges of the two side plates 101 and the top edge of the at least one vertical back plate 105 and may form at least one housing 130. At least one mounting element 102 may be rigidly connected to the top part of the housing. In an exemplary embodiment, screws may be used to connect the at least one mounting element 102 to the at least one housing 130. In an exemplary embodiment, the housing may have a height of about 20 cm to about 60 cm, have a width of about 10 cm to about 40 cm and may have a depth of about 5 cm to about 15 cm. It may be appreciated that the housing may have any desired dimensions. Additionally, the at least one mounting element 102 may be rotatably connected to the housing 130. In a further embodiment, a number of means 107 to rigidly connect the apparatus for light signaling 100 to a structure may be present on the at least one mounting element 102.

It may be appreciated that the housing may be constructed in one piece or may be composed of a number of elements. The elements may be connected by any means including but not limited to, welding, gluing, screwing, and riveting. The elements and the housing 103 may be made of a number of materials including, but not limited to, metal, plastic, aluminum, galvanized steel, polycarbonate, resin and engineered materials.

In an exemplary embodiment, a number of LED array and OLED 122 may be connected to the vertical back plate 105 in the inner part of the housing. At least one clear protective element 124 may cover the number of LED array and OLED 122 and be rigidly connected to the vertical back plate 105. It may be appreciated that the clear protection element 124 may be of any desired materials including, but not limited to, polyacrylates, polyethylene, and glass.

In an exemplary embodiment, the clear protection layer may also be covered with filters including, but not limited to, colored filters and polarizing filters. Electrical connection for the number of LED array and OLED may be covered by at least one protective plate 110, which may be rigidly connected to the bottom of the vertical back plate. Additionally, a number of reflectors 108 may be rigidly attached on the inward facing side of the two side plates 101. Wires and electrical leads may be ran under the protective plate 110 and side plates 101.

In an exemplary embodiment, an electrical box 106 may be rigidly connected to the housing 130. Additional electric and electronic components may be located in the electrical box 106. Further, an electrical conduit 104 may be connected to the electrical box 106. It may be appreciated that the electrical box 106 may be situated at any desired position on the apparatus for light signaling 100.

Figure 2:
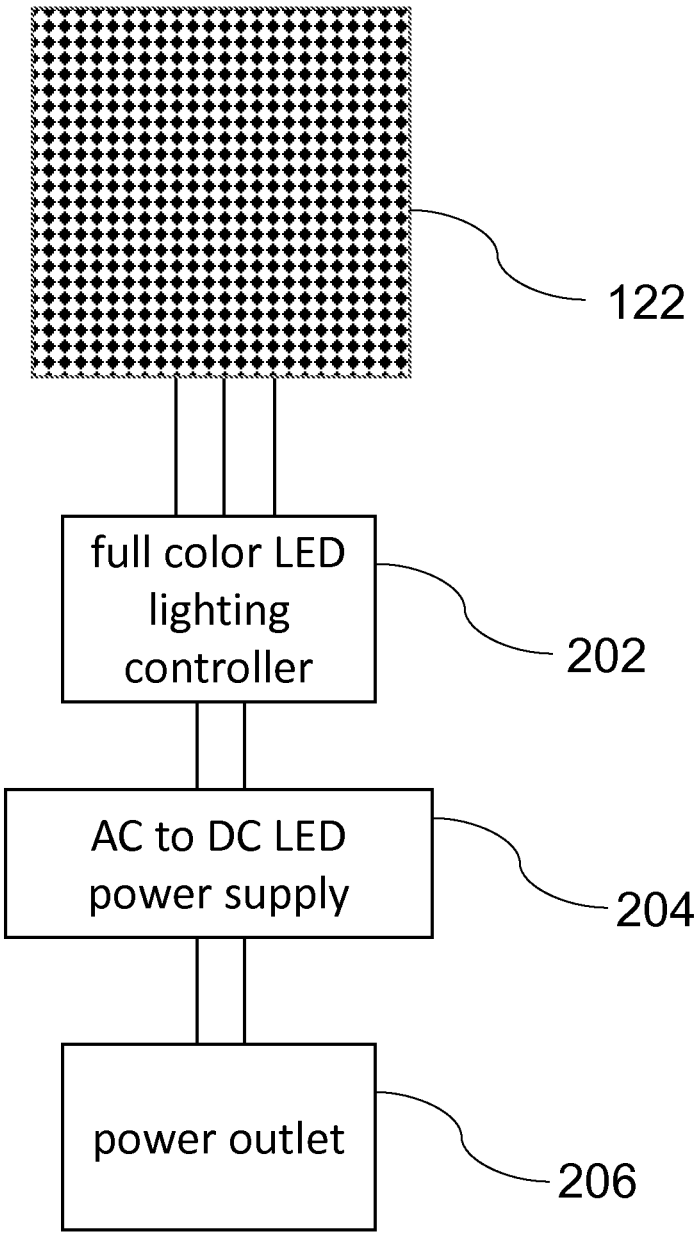
FIG. 2 may illustrate an exemplary embodiment of the power supply and electrical control of the LED array.

In an exemplary embodiment illustrated in FIG. 2, the number of LED array and OLED 122 may be connected in series with a full color LED lighting controller 202 and an AC to DC LED power supply 204 connected to a power outlet 206. In an exemplary embodiment, the full color LED lighting controller 202 may operate from about 12 V to about 26 V at a current of at most 8 A and the AC to DC LED power supply 204 may operate with an AC input from about 100 V to about 240 V and 0.5 A and with a DC output of 24 V and 1.67 A. It may be appreciated that the full color LED lighting controller 202 and the AC to DC LED power supply 204 may have any desired specifications. The full color LED lighting controller 202 and the AC to DC LED power supply 204 may be kept in the electrical box.

Figure 3:
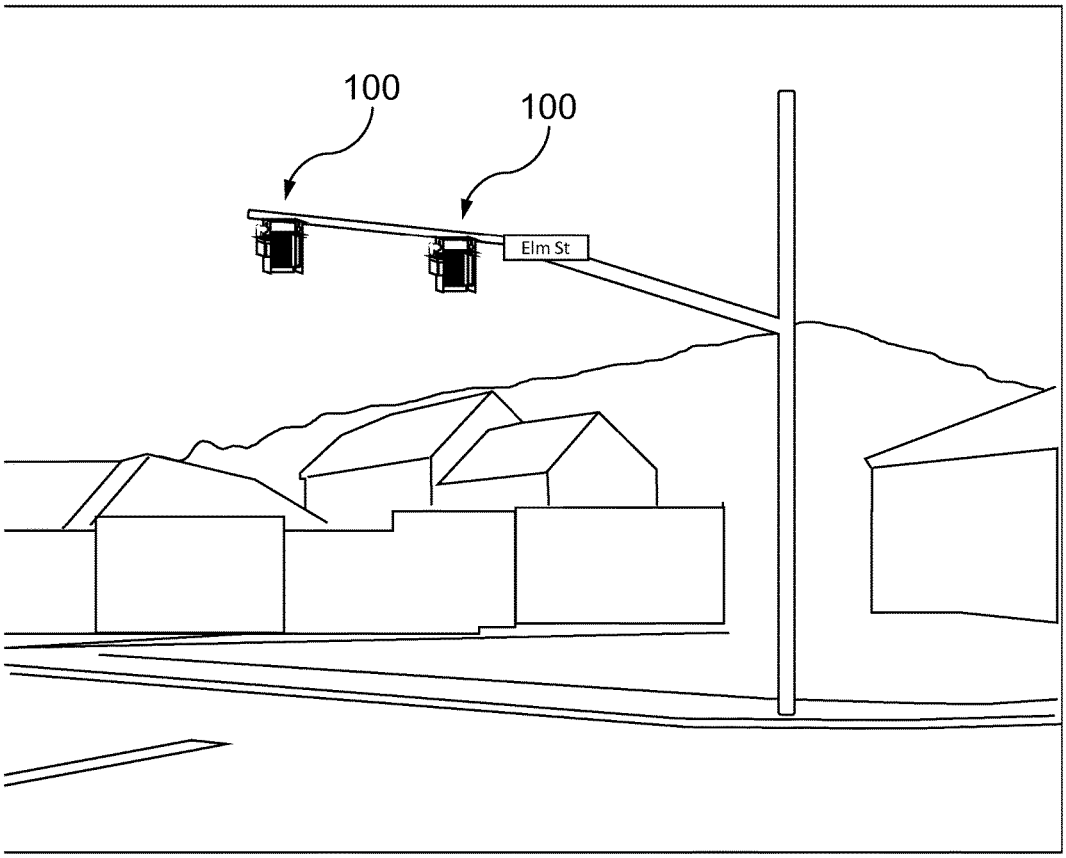
FIG. 3 may illustrate the apparatus placed in a visible location over a road.

In an exemplary embodiment illustrated in FIG. 3, the apparatus for light signaling 100 may be installed in a visible location and may display sign directed at traffic. The apparatus for light signaling 100 may be mounted in a variety of positions along a thoroughfare including but not limited to roads, highways, streets, rail roads, waterways and may be used to direct traffic. Further, the apparatus for light signaling may be fixed to a mean for transport.

Figure 4A:
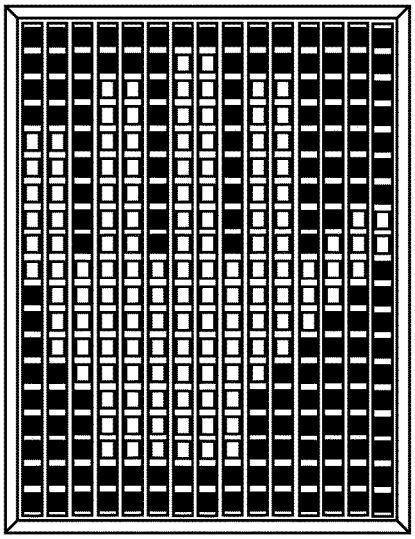
FIG. 4A may illustrate an exemplary embodiment of a LED array displaying the shape of a hand.
Figure 4B:
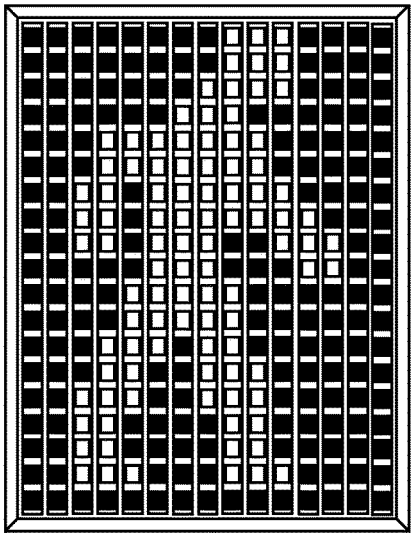
FIG. 4B may illustrate an exemplary embodiment of a LED array displaying the shape of a walking man silhouette.
Figure 4C:
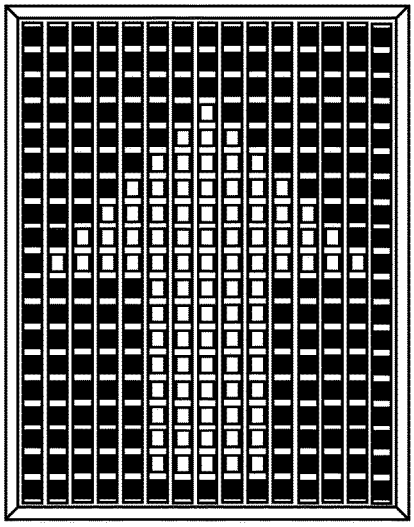
FIG. 4C may illustrate an exemplary embodiment of a LED array displaying the shape of and arrow.
Figure 4D:
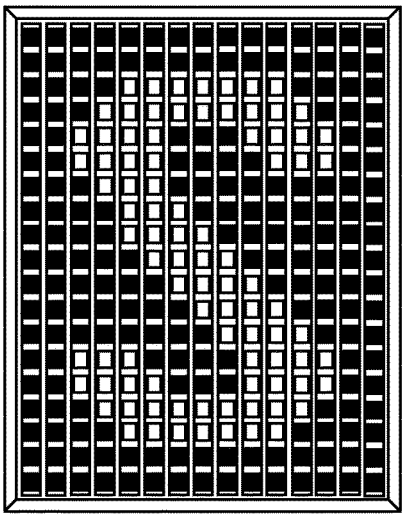
FIG. 4D may illustrate an exemplary embodiment of a LED array displaying the shape of the letter S.

In an exemplary embodiment illustrated in FIG. 4*a*-4*d*, a number of LED array and OLED 122 may be selected and lighted to form a shape or define a silhouette including but not limited to a hand (FIG. 4*a*), a man walking (FIG. 4*b*), an arrow (FIG. 4*c*), and a letter S (FIG. 4*d*). It may be appreciated that any desired shape may be displayed by the led array.

In an exemplary embodiment, the LED lightning controller 202 may be connected to a peripheral controller. The peripheral controller may be physically connected to the LED lightning controller 202 through wires. However it may also be appreciated that the LED lightning controller 202 may be wirelessly connected to the peripheral controller In another exemplary embodiment the apparatus for light signaling 100 may display a variety of designs, such as letters, words, symbols, and numbers. These designs may be directed to a number of usages including, but not limited to, commercial advertisement, home decor, public announcement, and entertainment.

Figure 5:
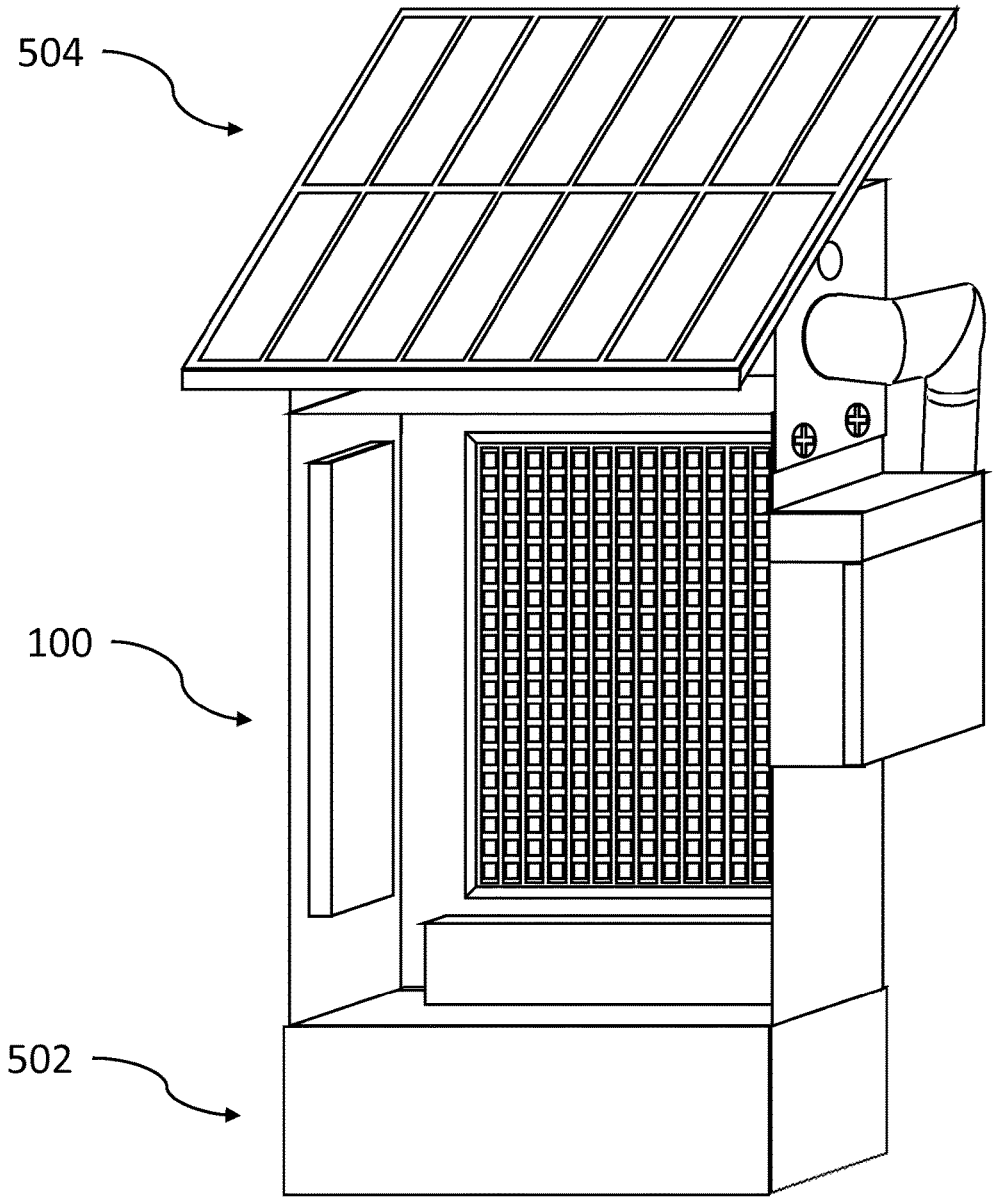
FIG. 5 may illustrate an exemplary embodiment of a solar panel and battery pack connected to the apparatus for signaling with light.

Now referring to FIG. 5, an exemplary embodiment of the apparatus for light signaling 100 may be connected to a battery pack 502 that may be located nearby and may optionally be rigidly attached to the apparatus for light signaling 100. The battery pack may be connected to the main electricity supply and may provide power to the apparatus for light signaling 100 when necessary, for example, during power outage. The battery pack 502 may be able to provide about 45 watts of power. However, it may be appreciated that the battery pack 502 may have any desired power capability.

In a further exemplary embodiment, solar panels 504 may provide power the battery pack 502. The solar panels 504 may be mounted near the apparatus for light signaling 100 and may optionally be rigidly attached to the apparatus for light signaling 100. It may be appreciated that the solar panels may be mounted in any desired location.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An apparatus for traffic light signaling comprising:

at least one of an LED array and an OLED, each of which comprises a multi-colored LED;

at least one LED lighting controller connected to the at least one of the LED array and the OLED to control a lighting color of the at least one of the LED array and the OLED, such that traffic signals with different colors are displayed within a same area of the at least one of the LED array and the OLED;

at least one AC to DC power supply connected to the at least one LED lighting controller;

at least one clear protective element covering the at least one of the LED array and the OLED;

at least one housing comprising a vertical back plate and at least two lateral side plates, wherein the vertical back plate contains the at least one of the LED array and the OLED, and the at least two lateral side plates extend forwardly from edges of the vertical back plate beyond a surface of the at least one of the LED array and the OLED;

an electrical box attached to an outward-facing surface of one of the at least two lateral side plates and extending therefrom, wherein the electrical box contains the AC to DC power supply and the at least one LED lighting controller;

at least one reflector rigidly attached to at least one inward-facing surface of the at least two lateral side plates; and at least one mounting element connected to the housing.

2. The apparatus of claim 1, wherein the at least one of the LED array and the OLED displays at least one of words, letters, colors and signs related to directing traffic.

3. The apparatus of claim 1, wherein the housing has a height of about 20 cm to about 60 cm, a width of about 10 cm to about 40 cm and a depth of about 5 cm to about 15 cm.

4. The apparatus of claim 1, wherein the at least one clear protective element includes at least one of polyacrylates, polyethylene, and glass.

5. The apparatus of claim 1, wherein the at least one LED lighting controller operates from about 12 V to about 26 V, and a current of at most 8 A.

6. The apparatus of claim 1, wherein the at least one AC to DC power supply operates with an AC input from about 100 V to about 240 V and 0.5 A, and with a DC output of 24 V and 1.67 A.

7. The apparatus of claim 1, wherein the apparatus for traffic light signaling is mounted in a variety of positions along at least one of thoroughfare, roads, highways, streets, rail roads, and waterways.

8. The apparatus of claim 1, wherein the apparatus for traffic light signaling is fixed to a mean for transport.

9. The apparatus of claim 1, wherein the AC to DC power supply for traffic light signaling is powered by at least one of a battery and a solar panel, and the at least one clear protective element is covered with at least one filter.

10. A method for reducing the cost of traffic light signaling comprising the steps of:

obtaining an apparatus for light signaling comprising:

at least one of an LED array and an OLED, each of which is a multi-colored LED, at least one LED lighting controller connected to the at least one of the LED array and the OLED to control a lighting color of the at least one of the LED array and the OLED, such that traffic signals with different colors are displayed within a same area of the at least one of the LED array and the OLED, at least one AC to DC power supply connected to the at least one LED lighting controller, at least one clear protective element covering the at least one of the LED array and the OLED, at least one housing comprising a vertical back plate and at least two lateral side plates, wherein the vertical back plate contains the at least one of the LED array and the OLED, and the at least two lateral side plates extend forwardly from edges of the vertical back plate beyond a surface of the at least one of the LED array and the OLED, an electrical box attached to an outward-facing surface of one of the at least two lateral side plates and extending therefrom, wherein the electrical box contains the AC to DC power supply and the at least one LED lighting controller, at least one reflector rigidly attached to an inward-facing surface of the at least two lateral side plates; and at least one mounting element connected to the housing;

placing the apparatus for signaling in a visible location;

connecting the apparatus to a power source; and powering the apparatus.

11. The method of claim 10, wherein the at least one of the LED array and the OLED displays at least one of words, letters, colors and signs related to directing traffic.

12. The method of claim 10, wherein the housing has a height of about 20 cm to about 60 cm, a width of about 10 cm to about 40 cm and a depth of about 5 cm to about 15 cm.

13. The method of claim 10, wherein the at least one clear protective element includes at least one of polyacrylates, polyethylene, and glass.

14. The method of claim 10, wherein the at least one LED lighting controller operates from about 12 V to about 26 V, and at current of at most 8 A.

15. The method of claim 10, wherein the at least one AC to DC power supply operates with an AC input from about 100 V to about 240 V at about 0.5 A, and with a DC output of 24 V at about 1.67 A.

16. The method of claim 10, wherein the apparatus for traffic light signaling is mounted in a variety of positions along at least one of thoroughfare, roads, highways, streets, rail roads, and waterways.

17. The method of claim 10, wherein the apparatus for traffic light signaling is fixed to a mean for transport.

18. The method of claim 10, wherein the AC to DC power supply for traffic light signaling is powered by at least one of a battery and a solar panel, and the at least one clear protective element is covered with at least one filter.

* * * * *